US008534863B2

(12) United States Patent
Yeh

(10) Patent No.: US 8,534,863 B2
(45) Date of Patent: Sep. 17, 2013

(54) LED LAMP WITH HERMETICAL END HOLDERS

(75) Inventor: Chih-Liang Yeh, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 207 days.

(21) Appl. No.: 13/275,323

(22) Filed: Oct. 18, 2011

(65) Prior Publication Data

US 2012/0106143 A1 May 3, 2012

(30) Foreign Application Priority Data

Oct. 29, 2010 (TW) ..... 099137075 A

(51) Int. Cl.
*F21V 7/00* (2006.01)

(52) U.S. Cl.
USPC ..... 362/217.05; 362/217.01; 362/249.02; 362/267

(58) Field of Classification Search
USPC ..... 362/217.05, 217.01, 249.02, 267
See application file for complete search history.

(56) References Cited

U.S. PATENT DOCUMENTS 7,303,310 B2 * 12/2007 You et al. ..... 362/240
8,038,324 B2 * 10/2011 Chen ..... 362/267

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

An LED lamp includes a frame, a power module, an envelope, an LED module, two holders, and a waterproof connecter. The frame includes a tube having an electrical section and a reflector. The power module is received in the electrical section. The envelope is engaged with the reflector to cooperatively define an optical section. The LED module is received in the optical section and electrically connects with the power module. The holders are mounted at two ends of the frame to prevent external hydrosphere from entering the LED lamp. Each of the holders includes a first cover and a second cover. The first covers engage with opposite ends of the electrical section. The second covers engage with opposite ends of the optical section. The waterproof connecter is coupled to one of the first covers.

16 Claims, 4 Drawing Sheets

LED LAMP WITH HERMETICAL END HOLDERS

BACKGROUND

1. Technical Field

The disclosure relates to LED (light emitting diode) lamps, and particularly to an LED lamp with end holders preventing hydrosphere or humidity from entering the LED lamp.

2. Description of the Related Art

As light emitting diodes (LEDs) come with the features of low power consumption, power saving, long service time, small size and quick response etc., LED lamps, such as LED tubes, gradually substitute traditional light sources. Generally, an LED tube includes a lamp shell to receive an LED module therein and a power module mounted at an exterior of the lamp shell. Hydrosphere will enter the lamp shell to destroy the LED module or directly destroy the power module.

What is needed, therefore, is an LED lamp which can overcome the limitations described.

DETAILED DESCRIPTION

Figure 1:
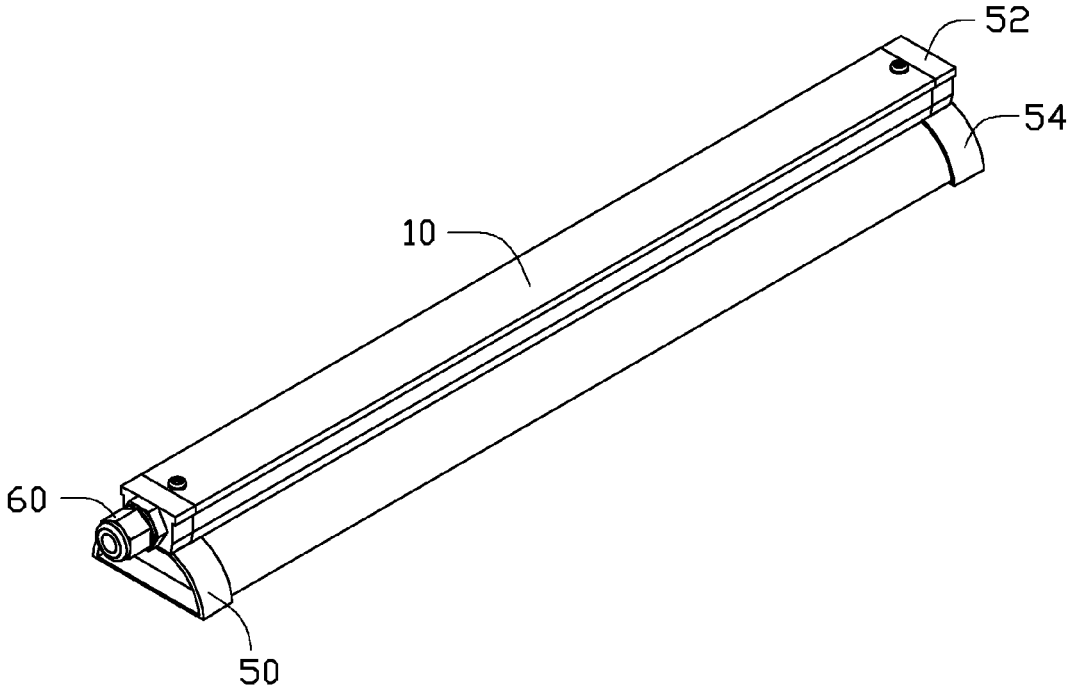
FIG. 1 is an isometric, assembled view of an LED lamp in accordance with an exemplary embodiment of the disclosure.

Reference will be made to the drawing figures to describe the present LED lamp in detail.

Figure 2:
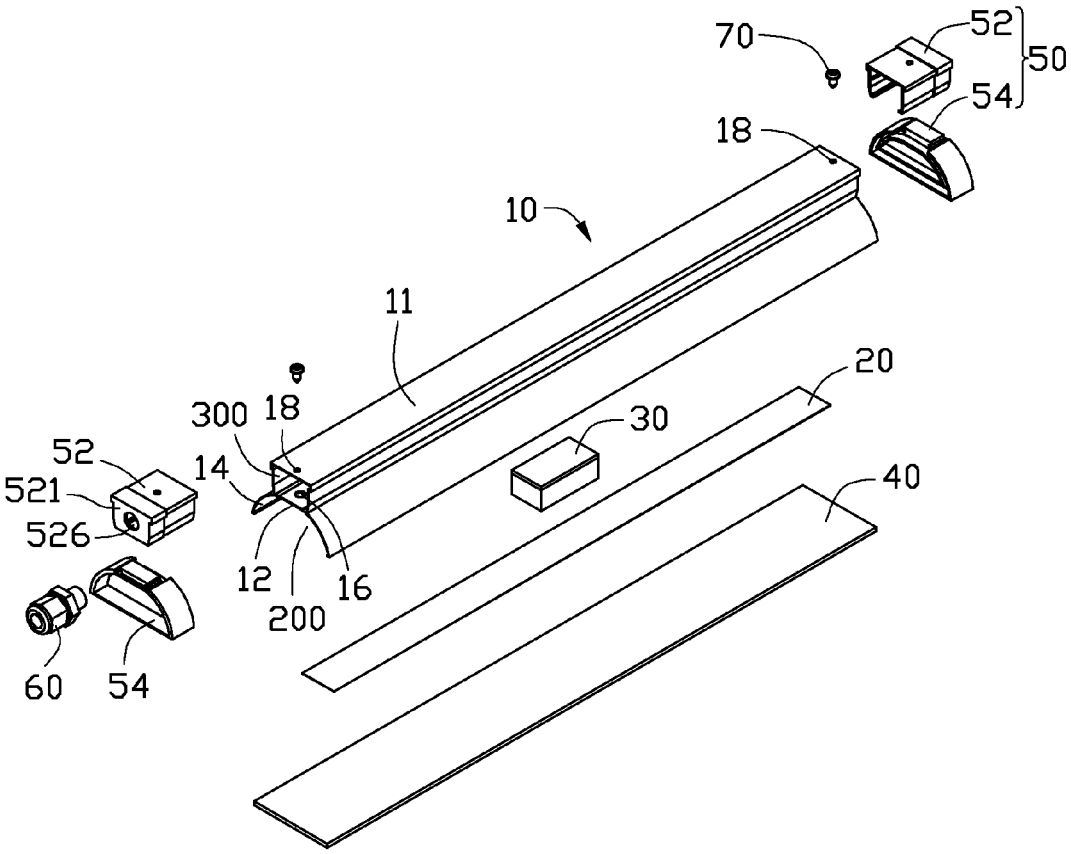
FIG. 2 is an exploded view of the LED lamp of FIG. 1.

Referring to FIGS. 1-2, an LED lamp in accordance with an exemplary embodiment of the disclosure is illustrated. The LED lamp includes a frame 10, an LED module 20, a power module 30, an envelope 40, and two holders 50 respectively engaged with two ends of the frame 10.

The frame 10 is integrally formed of a metal with good heat conductivity such as aluminum or an aluminum alloy as a single piece. In this embodiment, the frame 10 is formed by aluminum extrusion. The frame 10 includes a tube 11 and a reflector 14 integrally extending from the tube 11.

The tube 11 is hollow, elongated and has a rectangular cross section. The tube 11 includes a supporting plate 12 at a bottom thereof. The supporting plate 12 defines two connecting holes 16 each near a corresponding holder 50. A top of the tube 11 defines two screw holes 18 near two ends thereof. An interior of the tube 11 functions an electrical section 300 to receive the power module 30 therein.

The reflector 14 extends from opposite lateral sides of a bottom of the supporting plate 12. The reflector 14 is elongated. An inside surface of the reflector 14 is curved, and coated with reflective material. The envelope 40 tightly engages with a bottom of the reflector 14. The supporting plate 12, the reflector 14 and the envelope 40 cooperatively defines an optical section 200 to receive the LED module 20 therein.

The LED module 20 includes an elongated printed circuit board (not labeled) and a plurality of LEDs (not shown) mounted at a bottom surface of the printed circuit board. The LED module 20 is received in the optical section 200 and fixed to a bottom surface of the supporting plate 12. Light emitted from the LED module 20 is reflected by the reflector 14 and through the envelope 40 to an external environment of the LED lamp.

The power module 30 is received in the electrical section 300 of the tube 11 and mounted on an upper surface of the supporting plate 12. The power module 30 provides drive power, control circuit and power management for the LED module 20. A plurality of electrical wires (not shown) extends through the connecting holes 16 of the supporting plate 12 to electrically connect the power module 30 and LED module 20 together. Since the connecting holes 16 are defined in an inner of the LED lamp to reduce holes between the LED lamp and the environment, a hermetic capability of the LED lamp is enhanced.

The holders 50 are hermetically engaged with two ends of the frame 10, respectively. Each of the holders 50 includes an upper first cover 52 engaged with the electrical section 300 and a lower second cover 54 engaged with the optical section 200. The first cover 52 and the second cover 54 of each holder 50 are separately manufactured and then coupled together.

Figure 3:
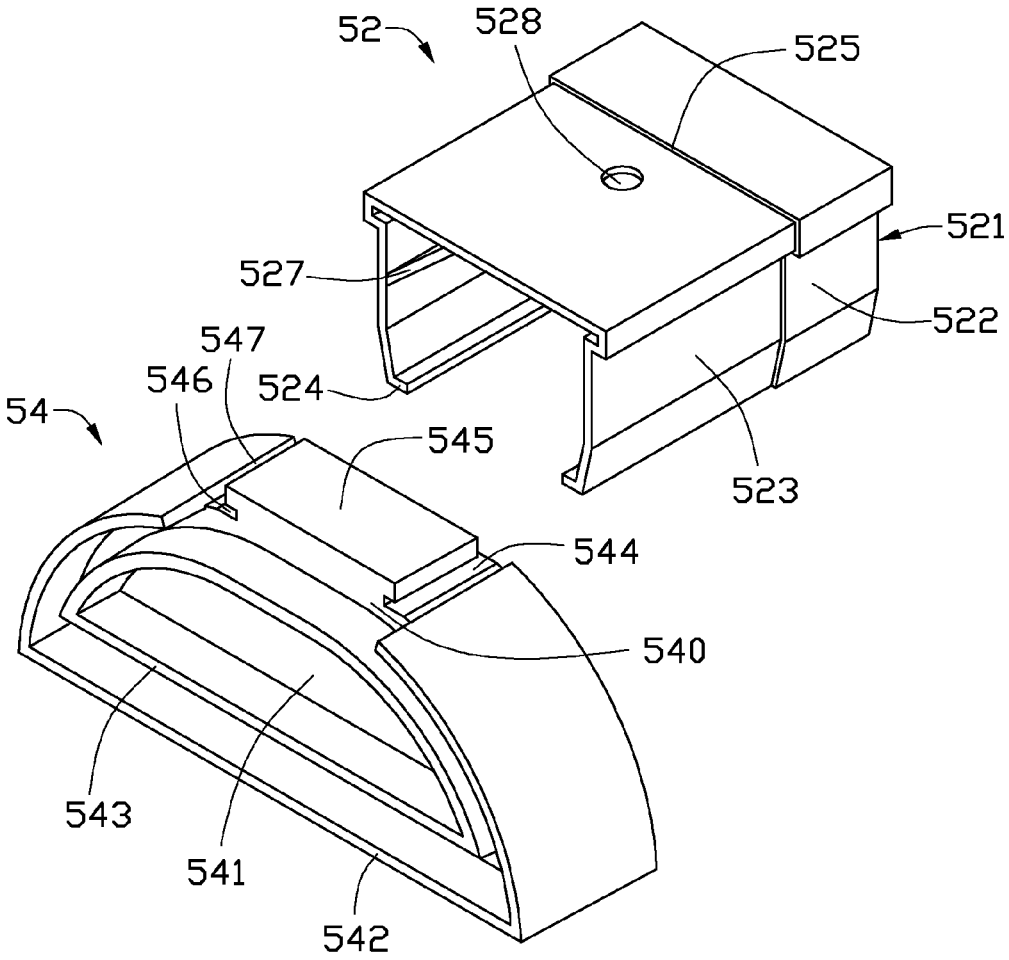
FIG. 3 is an exploded view of one holder of the LED lamp of FIG. 2.

Referring to FIG. 3, each of the first covers 52 includes a vertical first side plate 521, a first wall 522, and a second wall 523. The first side plate 521 has a profile corresponding to the cross section of the tube 11. The first wall 522 extends from an outer edge of the first side plate 521 towards the tube 11. The second wall 523 extends from the first wall 522 towards the tube 11. Each of the first wall 522 and the second wall 523 has a generally U-shaped cross section, with bottom sides thereof being open. A step portion 525 is formed between the first wall 522 and the second wall 523. Two coupling flanges 524 respectively extend from opposite sides of the bottoms of the first wall 522 and the second wall 523 towards each other. The first and second walls 522, 523 form two ribs 527 at inner lateral sides (not labeled) thereof. Each of the ribs 527 has a gradually increased thickness in respective to the corresponding inner lateral side along a direction from the second wall 523 to the first wall 522. The second wall 523 defines a screw hole 528 in a top thereof aligned with one screw hole 18 of the tube 11. The screw 70 can extend through the screw hole 528 into the screw hole 18. Also referring to FIG. 2, the first side plate 521 of one first cover 52 defines a through hole 526. A waterproof connecter 60 is engaged in the through hole 526 for wires extending therethrough to connect the power module 30 to an external power source (not shown).

The second cover 54 includes a second side plate 541, an outer wall 542, and an inner wall 543. The outer wall 542 connects to an outer edge of the second side plate 541 and is perpendicular to the second side plate 541. The inner wall 543 perpendicularly extends from the second side plate 541 towards the reflector 14. The inner wall 543 is spaced from the outer wall 542 and surrounded by the outer wall 542. The second side plate 541 has a profile similar to a cross section of the reflector 14. The outer wall 542 defines a cutout 540 at a top thereof near the reflector 14. The second cover 54 includes a first baffling plate 544 and a second baffling plate 545 extending outwards from a top of the second side plate 541 and outside the cutout 540. The second baffling plate 545 is spaced from the outer wall 542 to define two grooves 547 therebetween. The first baffling plate 544 defines two slits 546 respectively communicating with the grooves 547 for receiving the coupling flanges 524 of the first cover 52.

Figure 4:
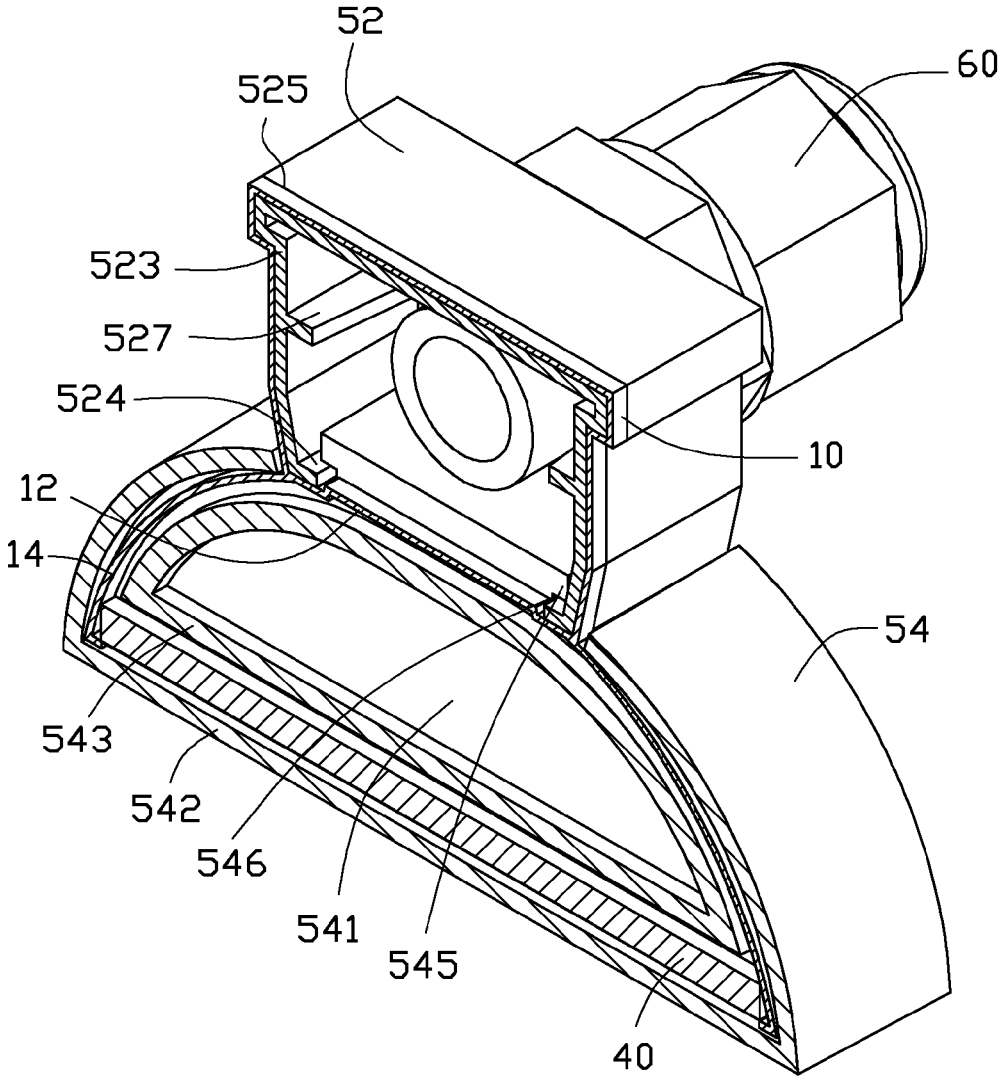
FIG. 4 is a cutaway view of a part of the assembled LED lamp of FIG. 1, shown from a different aspect.

Referring to FIG. 4, in assembly, the LED module 20 is mounted in the optical section 200, and the power module 30 is mounted in the electrical section 300 of the tube 11. The second covers 54 of the holders 50 mounted at two ends of the optical section 200. Ends of the reflector 14 and the envelope 40 are sandwiched between the outer wall 542 and the inner wall 543 and abut against the second side plates 541. The first covers 52 are mounted at ends of the electrical section 300 and coupled to the second covers 54. The coupling flanges 524 are received in the slits 546 of the second covers 54 and abut against the supporting plate 12 of the tube 11. The second walls 523 extend into the tube 11. The ends of the tube 11 abut against the step portions 525 of the first covers 52. The electrical wires of the power module 30 extend through the waterproof connecter 60 engaged in the through hole 526 of the first cover 52. Finally, each of the screws 70 is engaged in the screw holes 18 of the tube 11 and the screw holes 528 of the first cover 52 to fasten the holder 50 on the frame 10.

Since the first cover 52 and the second cover 54 are separately manufactured and tightly enclose the ends of the optical section 200 and the electrical section 300, the cost for manufacturing the holders 50 can be considerably reduced. Additionally, one of the holders 50 is mounted with the waterproof connecter 60 for extension of the electrical wires, whereby external hydrosphere can be prevented from entering the LED lamp.

It is to be further understood that even though numerous characteristics and advantages have been set forth in the foregoing description of the embodiment(s), together with details of the structures and functions of the embodiment(s), the disclosure is illustrative only; and that changes may be made in detail, especially in the matters of shape, size, and arrangement of parts within the principles of the disclosure to the full extent indicated by the broad general meaning of the terms in which the appended claims are expressed.

What is claimed is:

1. An LED lamp, comprising:

a frame comprising a tube and a reflector extending from the tube, the tube having an electrical section;

a power module received in the electrical section of the tube;

an envelope engaged with the reflector, the envelope and the reflector cooperatively defining an optical section;

an LED module received in the optical section and electrically connecting with the power module;

two holders mounted at two ends of the frame to prevent external hydrosphere from entering the electrical section and the optical section, each of the holders comprising a first cover and a second cover coupled to the first cover, the first covers of the holders coupling opposite ends of the electrical section, the second covers of the holders coupling opposite ends of the optical section; and a waterproof connecter coupled to one of the first covers.

2. The LED lamp of claim 1, wherein the first cover and the second cover of each holder are separately manufactured.

3. The LED lamp of claim 2, wherein each of the first covers comprises two coupling flanges at a bottom thereof, each of the second covers defining two slits to receive the coupling flanges.

4. The LED lamp of claim 1, wherein each of the first covers comprises a first side plate, a first wall extending from the an outer edge of the first side plate, and a second wall extending from the first wall, the second wall inserting into the tube.

5. The LED lamp of claim 4, wherein the each of the first covers comprises a step portion between the first wall and the second wall, the step portions abutting against outer edges of ends of the tube.

6. The LED lamp of claim 4, wherein the waterproof connecter is mounted at the first side plate of one of first covers.

7. The LED lamp of claim 4, wherein each of the second covers comprises a second side plate, an outer wall connecting to an outer edge of the second side plate, and an inner wall extending from the second side plate and surrounded by the outer wall.

8. The LED lamp of claim 7, wherein ends of the optical section are received in the second covers and sandwiched between the inner walls and the outer walls.

9. The LED lamp of claim 1, wherein the frame is integrally formed of aluminum as a single piece.

10. An LED (light emitting diode) lamp, comprising:

a frame comprising a tube and a reflector extending from the tube, the tube and the reflector being integrally formed as a single piece;

a power module received in the tube;

an envelope engaged with the reflector to form a space therebetween;

an LED module received in the space and electrically connecting with the power module;

two holders mounted at two ends of the frame to prevent external hydrosphere from entering the power module and the LED module, each of the holders comprising a first cover and a second cover coupling to the first cover, the first covers of the holders engaging opposite ends of the tube, the second covers of the holders engaging opposite ends of the reflector and the envelope, one of the first covers defining a through hole therein; and a waterproof connecter engaged in the through hole.

11. The LED lamp of claim 10, wherein the first cover and the second cover of each holder are separately manufactured.

12. The LED lamp of claim 11, wherein each of the first covers comprises two coupling flanges at a bottom thereof, each of the second covers defining two slits to receive the coupling flanges.

13. The LED lamp of claim 10, wherein each of the first covers comprises a first side plate, a first wall extending from the an outer edge of the first side plate, and a second wall extending from the first wall, the second wall inserting into the tube.

14. The LED lamp of claim 13, wherein the each of the first covers comprises a step portion between the first wall and the second wall, the step portions abutting against outer edges of the opposite ends of the tube.

15. The LED lamp of claim 13, wherein each of the second covers comprises a second side plate, an outer wall connecting to an outer edge of the second side plate, and an inner wall extending from the second side plate and surrounded by the outer wall.

16. The LED lamp of claim 15, wherein the opposite ends of the reflector and the envelope are received in the second covers and sandwiched between the inner walls and the outer walls.

* * * * *